US005192457A

United States Patent [19]

Nishimura

[11] Patent Number: 5,192,457

[45] Date of Patent: Mar. 9, 1993

[54] LUBRICATING OIL FOR USE UNDER RADIOACTIVE OR ENERGY IRRADIATION CONDITIONS

[75] Inventor: Jun Nishimura, Takahagi, Japan

[73] Assignee: Nok Kluber Company Ltd., Tokyo, Japan

[21] Appl. No.: 848,532

[22] Filed: Mar. 9, 1992

[51] Int. Cl.[5] ..... C10M 169/04; C10M 125/10

[52] U.S. Cl. ..... 252/25; 252/54

[58] Field of Search ..... 252/25, 54

[56] References Cited

U.S. PATENT DOCUMENTS 3,250,808 5/1966 Moore, Jr. et al. ..... 252/54

3,432,432 3/1969 Dreder ..... 252/25

3,788,987 1/1974 Bartlett ..... 252/54

5,032,302 7/1991 Jahlke et al. ..... 252/54

*Primary Examiner*—Jacqueline Howard

*Attorney, Agent, or Firm*—Fred Philpitt

[57] ABSTRACT

A finely pulverized alkaline earth metal oxide or an alkali metal oxide is added to perfluoropolyether oil represented by the general formula $Rf[CF(CF_3)CF_2O]_{5\sim60}Rf$, to absorb HF generated by decomposition of the perfluoropolyether at radioactive or energy irradiation of the perfluoropolyether oil, thereby effectively suppressing diffusion of HF into the oil or the gas phase.

5 Claims, No Drawings

LUBRICATING OIL FOR USE UNDER RADIOACTIVE OR ENERGY IRRADIATION CONDITIONS

BACKGROUND OF THE INVENTION

1. FIELD OF THE INVENTION

The present invention relates to a lubricating oil, and more particularly to a lubricating oil comprising perfluoropolyether oil as a base oil.

2. DESCRIPTION OF THE PRIOT ART

Perfluoropolyether oil is used in maintenance-free locations under stringent application conditions over a long time owing to its distinguished heat resistance, chemical resistance and inertness to many materials. However, when perfluoropolyether oil is used under radioactive or energy irradiation conditions, for example, as a lubricating oil for pumps in a nuclear reactor, a corrosive hydrogen fluorine gas is generated as a decomposition reaction product at the radioactive or energy irradiation, different from a phenylether-based lubricating oil, etc., and is diffused not only into the lubricating oil, but also much more into the gas phase. Thus, it is impossible to use a perfluoropolyether-based lubricating oil under radioactive or energy irradiation conditions.

On the other hand, the phenylether-based lubricating oil resistant to the radioactive or energy irradiation is poor in other required properties such as low temperature application, temperature-viscosity characteristics, heat resistance, chemical stability, etc.

SUMMARY OF THE INVENTION

An object of the present invention is to suppress diffusion of a decomposition product gas due to radioactive or energy irradiation of a lubricating oil comprising perfluoropoly-ether oil as a base oil, which has distinguished properties by itself.

DETAILED DESCRIPTION OF THE INVENTION

The present invention provides a lubricating oil comprising a perfluoropolyether oil and a finely pulverized metal oxide distributed in the perfluoropolyether oil.

Perfluoropolyether oil for use in the present invention is represented by the following general formula [I]:

$$Rf[CF(CF_3)CF_2O]nRf \qquad [I]$$

wherein Rf is a perfluoromethyl group or a perfluorethyl group and n is an integer of 5 to 60, and has a viscosity of about 10 to about 1,000 cst(40° C.). Commercially available perfluoropolyether can be practically used as it is.

Metal oxide for use in the present invention includes, for example, alkaline earth metal oxides such as magnesium oxide and calcium oxide and alkali metal oxides such as lithium oxide and sodium oxide, and is added to perfluoropolyether oil through a mixer, etc.

In order to maintain a specific surface area of the metal oxide to some extent, it is desirable to use about $10^{-8}$ to about 100 parts by weight, preferably about $10^{-2}$ to about 3 parts by weight, more preferably about $10^{-1}$ to about 3 parts by weight, of a metal oxide having an average particle size of not more than about 1,000 μm, preferably not more than about 100 μm, more preferably not more than about 3 μm, per 100 parts by weight of perfluoropolyether oil. Below about $10^{-8}$ parts by weight of the metal oxide, desired effect on the suppression of hydrogen fluoride gas diffusion cannot be obtained, whereas above 100 parts by weight the lubricating oil will be not in a liquid state, but in a semi-solid state, resulting in failure in the oil lubricating.

Perfluoropolyether oil generates $COF_2$ due to the decomposition reaction by radioactive or energy irradiation, owing to its structural nature. The generated $COF_2$ is an unstable substance and is very liable to undergo conversion to HF in the presence of $H_2O$ molecules, etc.

According to the present invention, diffusion of HF into the oil or the gas phase can be effectively suppressed by adding a metal oxide to the perfluoropolyether oil, thereby absorbing HF.

Furthermore, addition of finely pulverized metal oxide never increases unwanted abrasion. That is, addition of finely pulverized magnesium oxide, etc. effectively reduces the abrasion.

PREFERRED EMBODIMENTS OF THE INVENTION

The present invention will be explained in detail below, referring to Examples.

EXAMPLES 1-4 AND COMPARATIVE EXAMPLES 1-2

Uniform mixtures were prepared from 98 parts by weight of one of perfluoropolyether oil A [average molecular weight: about 3,500, viscosity: about 100 cst(40° C.)] and perfluoropolyether oil B [average molecular weight: about 7,500, viscosity: about 400 cst(40° C.)], represented by the foregoing general formula [I] and 2 parts by weight of finely pulverized metal oxide having an average particle size of about 1.4 μm in various combination given in the following TABLE 1 and gas-tightly placed in individual glass ampules, 25 mm in diameter and 250 mm long, and exposed to irradiation of $^{60}Co$ at 1 Mrad/hr for 16 hours (total 16 Mrad) in an upright state.

After the irradiation, the gas phase in each of the ampules was taken into a gas cell, 35 mm in diameter and 100 mm long, to measure absorption of $COF_2$ at 1,895 $cm^{-1}$ by an infrared spectrometer and calculate log $I_0/I$ according to the Lambert-Beer theory given by the following equation to determine the diffusion state of hydrogen fluoride gas:

$$\log I_0/I = \epsilon \cdot c \cdot l$$

wherein $I_0$: base line of peak

I: transmissivity (%) at the peak end

ε: extinction factor c: concentration l: thickness

ε and l will be always constant, when the same peak in the same cell is taken into account. Thus, log $I_0/I$ will be a concentration indicator.

The results are shown in TABLE 1 together with combinations of perfluoropolyether oil species and metal oxide species.

TABLE 1

| | Perfluoropolyether oil | Metal oxide | log $I_0/I$ |
|---|---|---|---|
| Example 1 | A | MgO | 0.00 |
| Example 2 | " | $Li_2O$ | " |
| Example 3 | " | CaO | " |

TABLE 1-continued

| | Perfluoropolyether oil | Metal oxide | log $I_o/I$ |
|---|---|---|---|
| Example 4 | B | MgO | " |
| Comp. Ex. 1 | A | — | 0.10 |
| Comp. Ex. 2 | B | — | 0.09 |

To determine abrasion due to the addition of metal oxide, a wearing test 1 by Soda-type, 4-sphere tester according to the JIS K-2519 procedure under the following conditions:

Oil hydraulic pressure: 4.0 kg/cm$^2$

Number of revolutions: 200 rpm

Test duration: 30 minutes

Test temperature: room temperature

The results are shown in the following TABLE 2.

TABLE 2

| | Abrasion flaw diameter (mm) |
|---|---|
| Example 1 | 0.95 |
| Example 2 | 1.42 |
| Example 3 | 1.43 |
| Example 4 | 0.79 |
| Comp. Ex. 1 | 1.40 |
| Comp. Ex. 2 | 1.10 |

What is claimed is:

1. A lubricating oil that is useful under radioactive or energy irradiation conditions which comprises a perfluoropolyether oil and a finely pulverized magnesium oxide distributed in the perfluoropolyether oil.

2. A lubricating oil according to claim 1 wherein the perfluoropolyether oil is represented by the general formula $$Rf[CF(CF_3)CF_2O]nRf$$

wherein Rf is a perfluoromethyl group or a perfluoroethyl group, and n is an integer of 5 to 60.

3. A lubricating oil according to claim 2 wherein the perfluoropolyether oil has a viscosity of about 10 to about 1,000 cst (40° C.).

4. A lubricating oil according to claim 1 wherein said finely pulverized magnesium oxide has an average particle size of not more than about 1,000 μm.

5. A lubricating oil according to claim 1 wherein about $10^{-8}$ to about 100 parts by weight of said finely pulverized magnesium oxide is used per 100 parts by weight of the perfluoropolyether oil.

* * * * *